US011322024B2

(12) United States Patent
Duran

(10) Patent No.: US 11,322,024 B2
(45) Date of Patent: May 3, 2022

(54) TRAFFIC CONTROL ASSEMBLY

(71) Applicant: Alex Duran, Flagstaff, AZ (US)

(72) Inventor: Alex Duran, Flagstaff, AZ (US)

( * ) Notice: Subject to any disclaimer, the term of this patent is extended or adjusted under 35 U.S.C. 154(b) by 0 days.

(21) Appl. No.: 16/990,670

(22) Filed: Aug. 11, 2020

(65) Prior Publication Data

US 2022/0051562 A1 Feb. 17, 2022

(51) Int. Cl.

| | |
|---|---|
| ***G08G 1/0967*** | (2006.01) |
| ***G08G 1/04*** | (2006.01) |
| ***G08G 1/00*** | (2006.01) |
| ***G08G 1/127*** | (2006.01) |

(52) U.S. Cl.

CPC ..... *G08G 1/096725* (2013.01); *G08G 1/04* (2013.01); *G08G 1/127* (2013.01); *G08G 1/205* (2013.01)

(58) Field of Classification Search

CPC .... G08G 1/096725; G08G 1/04; G08G 1/127; G08G 1/205

See application file for complete search history.

(56) References Cited

U.S. PATENT DOCUMENTS

| | | | | |
|---|---|---|---|---|
| 5,203,422 | A * | 4/1993 | Estep | B60T 7/22 180/169 |
| D471,172 | S | 3/2003 | Greenway | |
| 7,760,076 | B2 | 7/2010 | Boggess | |
| 8,125,349 | B2 | 2/2012 | May | |
| 8,239,076 | B2 | 8/2012 | McGarry | |
| 8,785,840 | B2 | 7/2014 | Schulte | |
| 8,905,176 | B2 | 12/2014 | Elson | |
| 10,407,853 | B1 * | 9/2019 | Dunn | E01F 13/105 |
| 2010/0082180 | A1 * | 4/2010 | Wright | B60W 50/0098 701/1 |
| 2014/0369748 | A1 | 12/2014 | Mitlo | |
| 2015/0146001 | A1 * | 5/2015 | White | H04N 5/23203 348/149 |
| 2018/0050693 | A1 * | 2/2018 | Al-Deek | B60W 10/18 |

FOREIGN PATENT DOCUMENTS

| | | |
|---|---|---|
| WO | WO2008118532 | 10/2008 |

* cited by examiner

*Primary Examiner* — Mohamed Barakat

(57) ABSTRACT

A traffic control assembly includes a plurality of motion sensors that is each positioned adjacent to a ramp of a highway. The motion sensors are spaced apart from each other and re distributed along a full length of the ramp. A control unit is in communication with each of the motion sensors and the control unit receives a plurality of inputs of sequentially increasing urgency when the motions sensors senses traffic moving the wrong way on the ramp. A disabling unit is positioned adjacent to the ramp of the highway and the disabling unit is in communication with the control unit. The disabling unit broadcasts an intense burst of electromagnetic energy when the disabling unit is turned on to disable the electrical system of a vehicle traveling the wrong way on the ramp.

12 Claims, 5 Drawing Sheets

TRAFFIC CONTROL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to traffic devices and more particularly pertains to a new traffic device for disabling a vehicle traveling the wrong way on a highway ramp.

(2) Description of Related Art Including Information Disclosed Under 37 CFR 1.97 and 1.98

The prior art relates to traffic devices including a kill code receiver installed in a vehicle that can receive a kill code from a transmitter for disabling the vehicle on a highway. The prior art discloses an illuminated highway sign for warning traffic going the wrong way on a roadway. The prior art discloses a communication device for wirelessly accessing a vehicle ignition computer to remotely disable the vehicle ignition computer. The prior art discloses a microwave transmission system that includes a plurality of vehicles, each having a microwave transmitter thereon, and a satellite for receiving and subsequently redirecting, microwave energy from the microwave transmitter on each vehicle for disabling a target vehicle. The prior art discloses a variety of microwave transmitters for remotely disabling a vehicle.

BRIEF SUMMARY OF THE INVENTION

An embodiment of the disclosure meets the needs presented above by generally comprising a plurality of motion sensors that is each positioned adjacent to a ramp of a highway. The motion sensors are spaced apart from each other and re distributed along a full length of the ramp. A control unit is in communication with each of the motion sensors and the control unit receives a plurality of inputs of sequentially increasing urgency when the motions sensors senses traffic moving the wrong way on the ramp. A disabling unit is positioned adjacent to the ramp of the highway and the disabling unit is in communication with the control unit. The disabling unit broadcasts an intense burst of electromagnetic energy when the disabling unit is turned on to disable the electrical system of a vehicle traveling the wrong way on the ramp.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
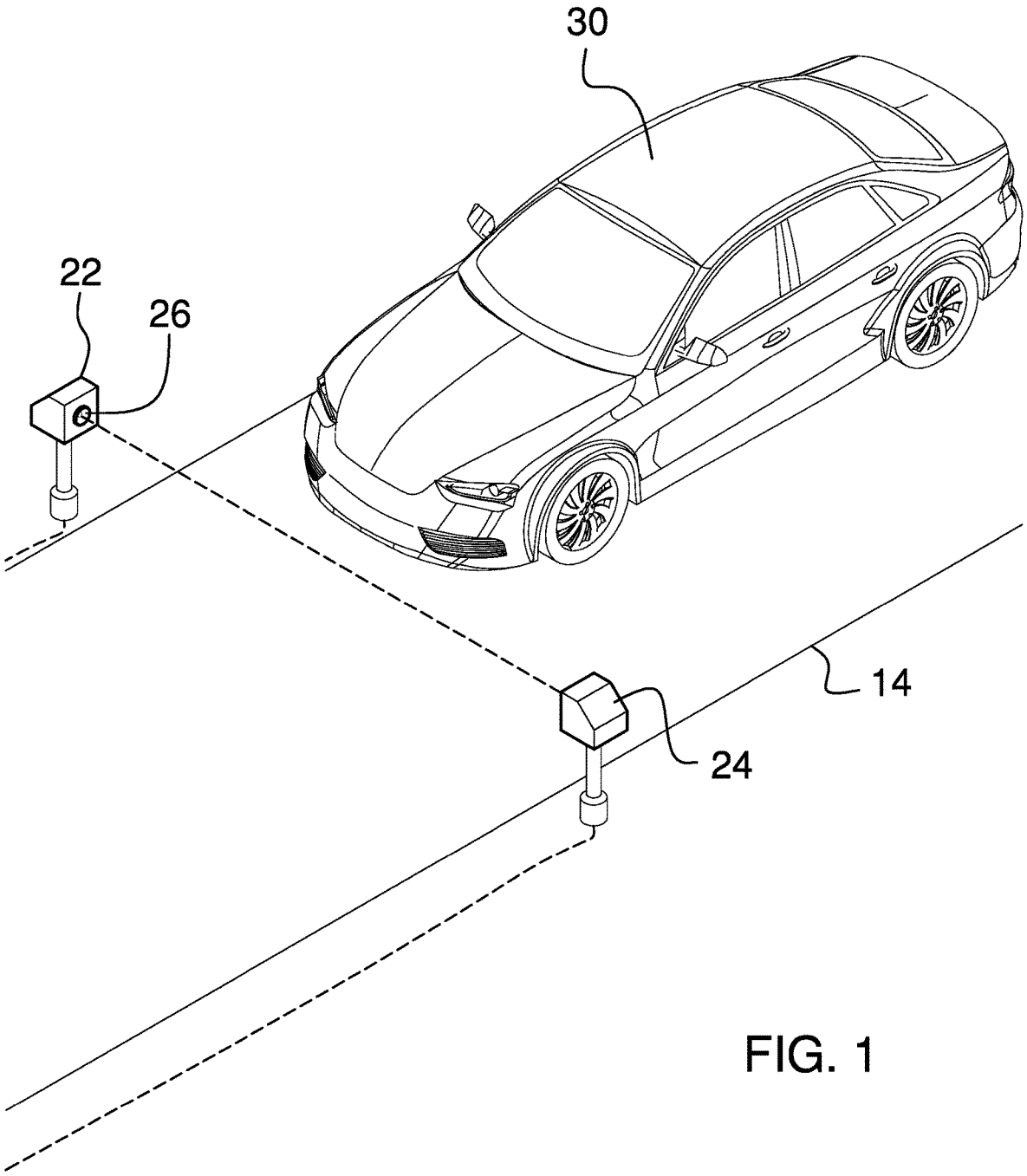
FIG. 1 is a perspective in-use view of a traffic control assembly according to an embodiment of the disclosure showing a vehicle approaching a pair of motion sensors.
Figure 2:
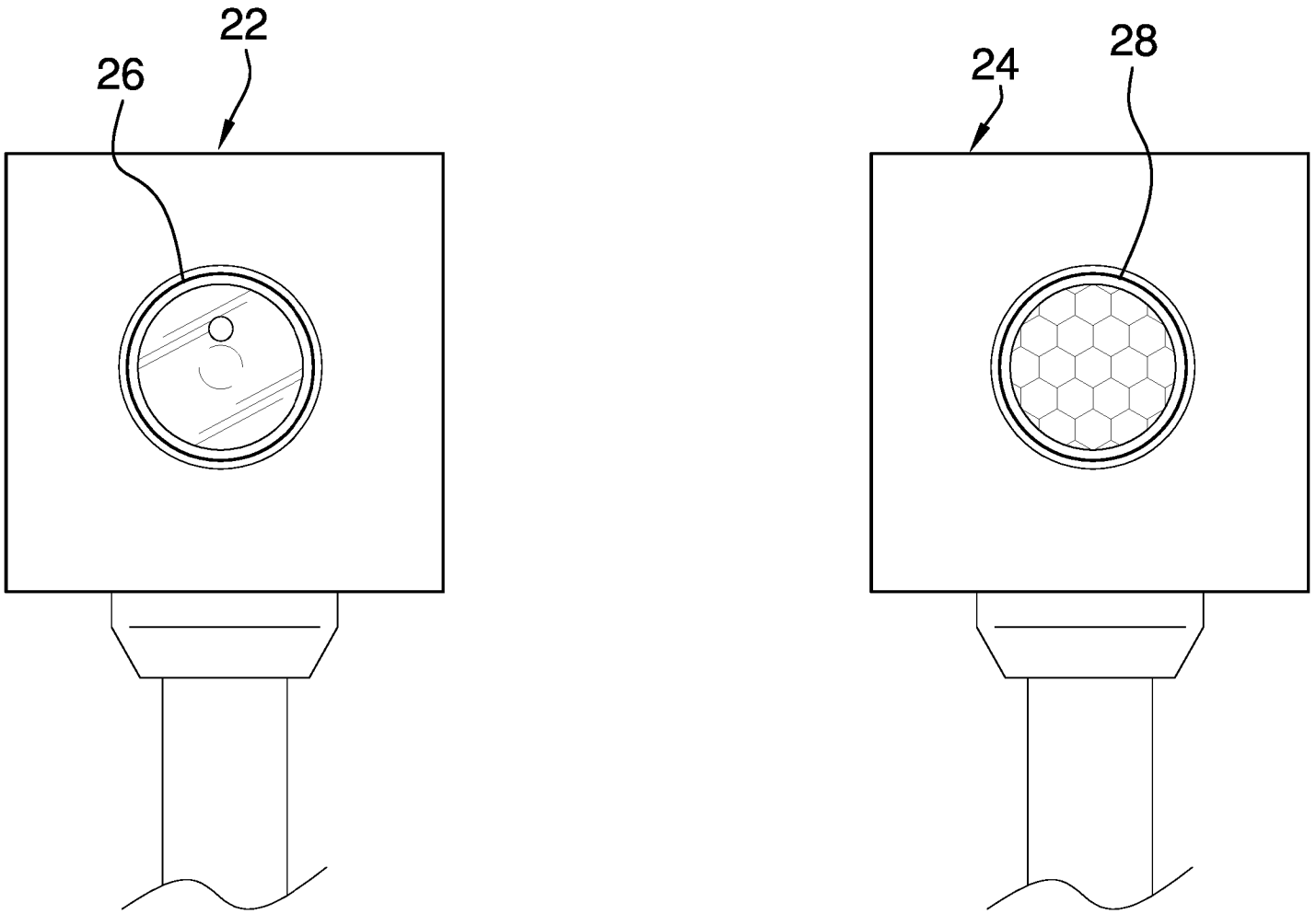
FIG. 2 is a front view of a first motion sensor and a second motion sensor of an embodiment of the disclosure.
Figure 3:
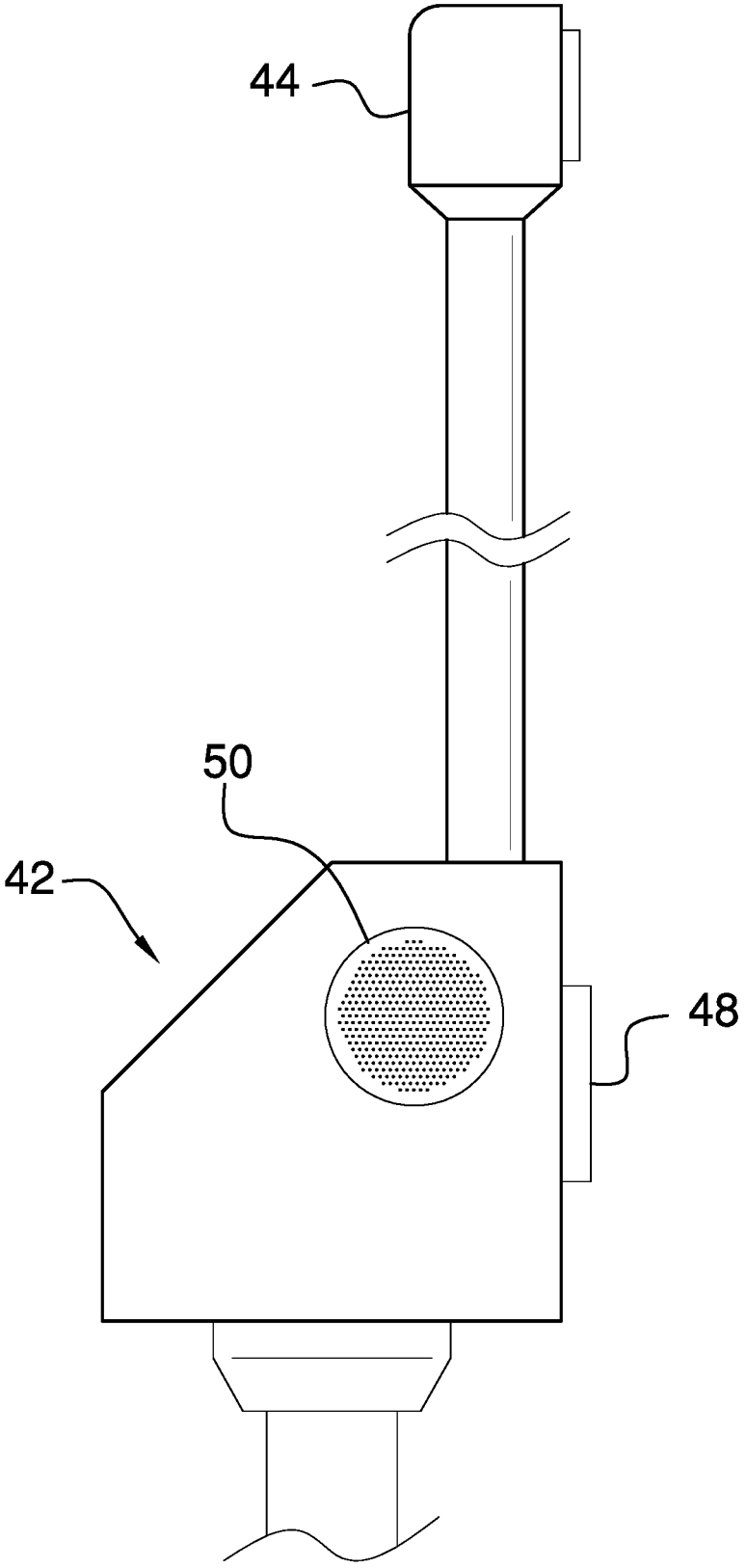
FIG. 3 is a perspective view of a disabling unit of an embodiment of the disclosure.
Figure 4:
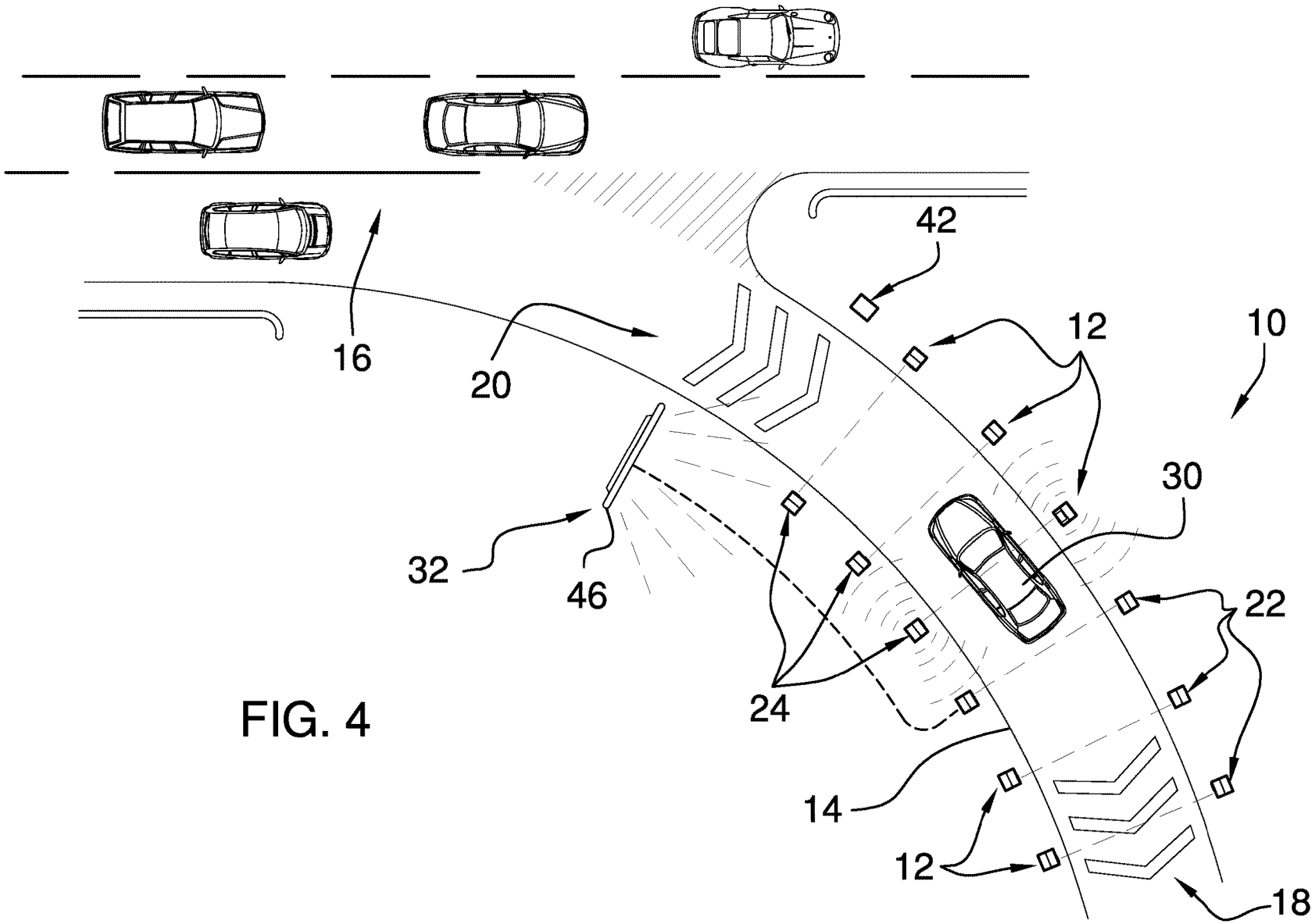
FIG. 4 is a perspective in-use view of an embodiment of the disclosure.
Figure 5:
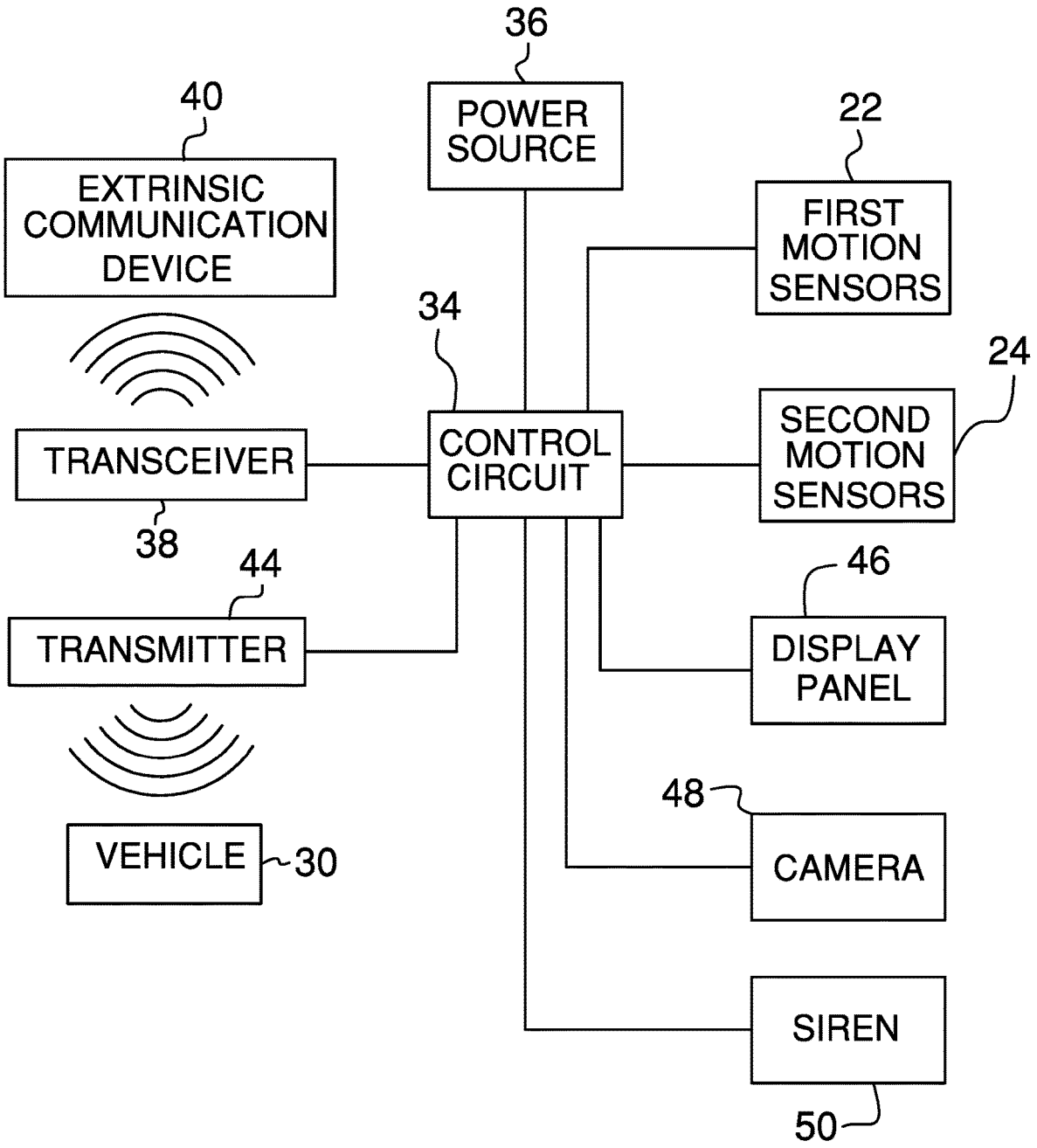
FIG. 5 is a schematic view of an embodiment of the disclosure.

With reference now to the drawings, and in particular to FIGS. 1 through 5 thereof, a new traffic device embodying the principles and concepts of an embodiment of the disclosure and generally designated by the reference numeral 10 will be described.

As best illustrated in FIGS. 1 through 5, the traffic control assembly 10 generally comprises a plurality of motion sensors 12 that is each positioned adjacent to a ramp 14 of a highway 16. In this way the plurality of motion sensors 12 can sense motion of traffic on the ramp 14. The ramp 14 may be an on ramp or an off ramp and the highway 16 may be any public highway upon which motor vehicles are driven. The motion sensors 12 are spaced apart from each other a distance of approximately 15.0 apart from each other and are distributed along a full length of the ramp 14 to track the motion of traffic on the ramp 14. Moreover, the plurality of motion sensors 12 is ordered from an exit of the ramp 18 to an entrance of the ramp 20 with respect to the intended flow of traffic on the ramp 14.

The plurality of motion sensors 12 comprises a set of first motion sensors 22 and a set of second motion sensors 24. The first motion sensors 22 are positioned on an opposite side of the ramp 14 from the second motion sensors 24. Additionally, each of the first motion sensors 22 is aligned with a respective one of the second motion sensors 24. Each of the first motion sensors 22 includes a light emitter 26 that emits a beam of light toward the respective second motion sensor 24. Moreover, each of the second motion sensors 24 includes a receiver 28 for receiving the beam of light from the respective first motion sensor 22.

The light emitter 26 in each of the first motion sensors 22 may comprise a laser light emitter or the like. The receiver 28 in each of the second motion sensors 24 may comprise an electronic laser light detector or the like. Each of the motion sensors 12 is assigned a value ranging between one and six starting from the exit of the ramp 18. In this way a vehicle 30 that enters the ramp 14 in the wrong direction will first encounter the motion sensor assigned with the value of one.

A control unit 32 is provided and the control unit 32 is in communication with each of the motion sensors 12. The control unit 32 receives a plurality of inputs that each has sequentially increased urgency when the motion sensors 12 senses traffic moving the wrong way on the ramp 14. The control unit 32 is in remote communication with emergency responders such as local police or the like. The control unit 32 contacts emergency responders when the control unit 32 receives the input of a highest urgency.

The control unit 32 comprises a control circuit 34 that is electrically coupled to each of the first motion sensors 22 and each of the second motion sensors 24. The control circuit 34 receives a first input when the motion sensors 12 assigned the value of one senses motion and the control circuit 34 receives a second input when the motion sensors 12 assigned the value of two senses motion. The control circuit 34 receives a third input when the motion sensors 12 assigned the value of three senses motion and the control circuit 34 receives a fourth input when the motion sensors 12 assigned the value of four senses motion. The control circuit 34 receives a firth input when the motion sensors 12 assigned the value of five senses motion and the control circuit 34 receives a sixth input when the motion sensors 12 assigned the value of six senses motion. Additionally, the control circuit 34 is electrically coupled to a power source 36 comprising an electrical supply line or public utility service.

A transceiver 38 is electrically coupled to the control circuit 34 and the transceiver 38 is in communication with an extrinsic communication network 40. In this way the transceiver 38 can broadcast an alert to the emergency responders. The transceiver 38 is electrically coupled to the control circuit 34 and the transceiver 38 broadcasts the alert when the control circuit 34 receives the sixth input. The transceiver 38 may comprise a radio frequency transceiver 38 or the like and the extrinsic communication network 40 may be a cellular phone network, the internet or other type of wireless communication network.

A disabling unit 42 is provided and the disabling unit 42 is positioned adjacent to the ramp 14 of the highway 16. The disabling unit 42 is positioned proximate the entrance of the ramp 20. The disabling unit 42 is in communication with the control unit 32 and the disabling unit 42 broadcasts an intense burst of electromagnetic energy when the disabling unit 42 is turned on. In this way the disabling unit 42 can disable the electrical system of a vehicle 30 traveling the wrong way on the ramp 14. Thus, the vehicle 30 is inhibited from entering the highway 16 in the wrong direction and potentially causing a fatal accident. The disabling unit 42 is turned on when the control unit 32 receives the input of the highest urgency.

The disabling unit 42 is electrically coupled to the control circuit 34 and the disabling unit 42 includes a transmitter 44 for broadcasting the intense burst of electromagnetic energy. The transmitter 44 may comprise a microwave frequency transmitter with a broadcast energy of at least 1.0 gigawatts. In this way the transmitter 44 can transmit a beam of microwave energy that is sufficient to disable the ignition system of the vehicle 30 going to wrong direction on the ramp 14. The transmitter 44 is actuated into a standby condition when the control circuit 34 receives the fifth input and the transmitter 44 is actuated to broadcast the intense burst of electromagnetic energy when the control circuit 34 receives the sixth input.

A display panel 46 is positioned adjacent to the ramp 14 such that the display panel 46 is visible to traffic going the wrong way on the ramp 14. The display panel 46 is in communication with the control unit 32 and the display panel 46 is turned on to display a visible alert when the control unit 32 receives any of the inputs. In this way the display panel 46 can visibly alert traffic going the wrong way on the ramp 14. The display panel 46 is electrically coupled to the control circuit 34 and the display panel 46 is turned on when the control circuit 34 receives the third input. The display panel 46 may comprise an LED or other similar type of electronic display.

A camera 48 is positioned adjacent to the ramp 14 to capture imagery of the traffic going the wrong way on the ramp 14. The camera 48 is in communication with the control unit 32 and the camera 48 is actuated to take a photo of the traffic when the control unit 32 receives the input of a medium urgency. The camera 48 is electrically coupled to the control circuit 34 and the camera 48 is actuated to take the photo when the control circuit 34 receives the fourth input. The camera 48 may comprise a digital video camera 48 or the like.

A siren 50 is positioned adjacent to the ramp 14 to emit an audible alarm for the traffic. The siren 50 is in communication with the control unit 32 and the siren 50 is turned on when the control unit 32 receives the input of a medium urgency. In this way the siren 50 can alert the traffic going the wrong way on the ramp 14. The siren 50 is electrically coupled to the control circuit 34 and the siren 50 is turned on when the control circuit 34 receives the fourth input. The siren 50 may comprise an electronic siren with a loudness of approximately 110.0 decibels to ensure a driver of the vehicle 30 can hear the siren 50.

In use, the control circuit 34 is actuated into a standby mode when the control circuit 34 receives the first input and the second input. In this way the driver of the vehicle 30 going the wrong way on the ramp 14 has the chance to back up and leave the ramp 14. The display panel 46 is turned on when the control circuit 34 receives the third input to visually alert the driver that they are driving the wrong way on the ramp 14. The siren 50 is turned on to audibly alert the driver and the camera 48 is turned on to capture a photo of the vehicle 30 when the control circuit 34 receives the fourth input. The transmitter 44 is actuated into the standby mode when the control circuit 34 receives the fifth input. Finally, the transmitter 44 broadcasts the intense burst of electromagnetic energy to disable the vehicle's 30 ignition when the control circuit 34 receives the sixth input. In this way the driver of the vehicle 30 is given ample opportunity to stop the vehicle 30 before the vehicle 30 is disabled. Thus, the vehicle 30 is inhibited from entering the highway 16 going the wrong direction.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A traffic control assembly for disabling a vehicle that is traveling the wrong way on a ramp of a highway, said assembly comprising:

a plurality of motion sensors, each of said motion sensors being positioned adjacent to a ramp of a highway wherein said plurality of motions sensors is configured to sense motion of traffic on the ramp, said motion sensors being spaced apart from each other and being distributed along a full length of the ramp wherein said plurality of motions sensors is configured to track the motion of traffic on the ramp, said plurality of motions sensors being ordered from an exit of the ramp to an entrance of the ramp with respect to the flow of traffic, wherein each of said motion sensors is assigned a value between one and six starting from the exit of the ramp;

a control unit being in communication with each of said motion sensors, said control unit receiving a plurality of inputs having sequentially increased urgency when said motions sensors senses traffic moving the wrong way on the ramp, said control unit being in remote communication with emergency responders, said control unit contacting emergency responders when said control unit receives said input of a highest urgency; and a disabling unit being positioned adjacent to the ramp of the highway, said disabling unit being positioned proximate the entrance of the ramp, said disabling unit being in communication with said control unit, said disabling unit broadcasting an intense burst of electromagnetic energy when said disabling unit is turned on wherein said disabling unit is configured to disable the electrical system of a vehicle traveling the wrong way on the ramp, said disabling unit being turned on when said control unit receives said input of said highest urgency;

wherein said control unit comprises a control circuit being electrically coupled to each of said first sensors and each of said second sensors, wherein said control circuit receives a first input when said motion sensors assigned the value of one senses motion, wherein said control circuit receives a second input when said motion sensors assigned the value of two senses motion, wherein said control circuit receives a third input when said motion sensors assigned the value of three senses motion, wherein said control circuit receives a fourth input when said motion sensors assigned the value of four senses motion, wherein said control circuit receives a firth input when said motion sensors assigned the value of five senses motion, wherein said control circuit receives a sixth input when said motion sensors assigned the value of six senses motion; and wherein said control circuit is electrically coupled to a power source; and wherein said disabling unit is electrically coupled to said control circuit, said disabling unit including a transmitter for broadcasting said intense burst of electromagnetic energy, said transmitter being actuated into a standby condition when said control circuit receives said fifth input, said transmitter being actuated to broadcast said intense burst of electromagnetic energy when said control circuit receives said sixth input.

2. The assembly according to claim 1, wherein said plurality of motions sensors comprises a set of first motion sensors and a set of second motion sensors, said first motion sensors being positioned on an opposite side of the ramp from said second motion sensors, each of said first motion sensors being aligned with a respective one of said second motion sensors.

3. The assembly according to claim 2, wherein each of said first motion sensors includes a light emitter emitting a beam of light toward said respective second motion sensor, each of said second motion sensors including a receiver for receiving the beam of light from said respective first motion sensor.

4. The assembly according to claim 1, further comprising a display panel being positioned adjacent to the ramp wherein said display panel is configured to be visible to traffic going the wrong way on the ramp, said display panel being in communication with said control unit, said display panel being turned on to display a visible alert when said control unit receives any of said inputs wherein said display panel is configured to visibly alert traffic going the wrong way on the ramp.

5. The assembly according to claim 1, further comprising a camera being positioned adjacent to the ramp wherein said camera is configured to capture imagery of the traffic going the wrong way on the ramp, said camera being in communication with said control unit, said camera being actuated to take a photo of the traffic when said control unit receives said input of a medium urgency.

6. The assembly according to claim 5, wherein said camera is electrically coupled to said control circuit, said camera being actuated to take the photo when said control circuit receives said fourth input.

7. The assembly according to claim 1, further comprising a siren being positioned adjacent to the ramp wherein said siren is configured to emit an audible alarm for the traffic, said siren being in communication with said control unit, said siren being turned on when said control unit receives said input of a medium urgency wherein said siren is configured to alert the traffic going the wrong way on the ramp.

8. The assembly according to claim 7, wherein said siren is electrically coupled to said control circuit, said siren being turned on when said control circuit receives said fourth input.

9. The assembly according to claim 1, wherein said control unit includes a transceiver being electrically coupled to said control circuit, said transceiver being in communication with an extrinsic communication network thereby facilitating said transceiver to broadcast an alert to the emergency responders.

10. The assembly according to claim 9, wherein said transceiver is electrically coupled to said control circuit, said transceiver broadcasting said alert when said control circuit receives said sixth input.

11. A traffic control assembly for disabling a vehicle that is traveling the wrong way on a ramp of a highway, said assembly comprising:

a plurality of motion sensors, each of said motion sensors being positioned adjacent to a ramp of a highway wherein said plurality of motions sensors is configured to sense motion of traffic on the ramp, said motion sensors being spaced apart from each other and being distributed along a full length of the ramp wherein said plurality of motions sensors is configured to track the motion of traffic on the ramp, said plurality of motions sensors being ordered from an exit of the ramp to an entrance of the ramp with respect to the flow of traffic, wherein each of said motion sensors is assigned a value between one and six starting from the exit of the ramp;

a control unit being in communication with each of said motion sensors, said control unit receiving a plurality of inputs having sequentially increased urgency when said motions sensors senses traffic moving the wrong way on the ramp, said control unit being in remote communication with emergency responders, said control unit contacting emergency responders when said control unit receives said input of a highest urgency;

a disabling unit being positioned adjacent to the ramp of the highway, said disabling unit being positioned proximate the entrance of the ramp, said disabling unit being in communication with said control unit, said disabling unit broadcasting an intense burst of electromagnetic energy when said disabling unit is turned on wherein said disabling unit is configured to disable the electrical system of a vehicle traveling the wrong way on the ramp, said disabling unit being turned on when said control unit receives said input of said highest urgency;

wherein said control unit comprises a control circuit being electrically coupled to each of said first sensors and each of said second sensors, wherein said control circuit receives a first input when said motion sensors assigned the value of one senses motion, wherein said control circuit receives a second input when said motion sensors assigned the value of two senses motion, wherein said control circuit receives a third input when said motion sensors assigned the value of three senses motion, wherein said control circuit receives a fourth input when said motion sensors assigned the value of four senses motion, wherein said control circuit receives a firth input when said motion sensors assigned the value of five senses motion, wherein said control circuit receives a sixth input when said motion sensors assigned the value of six senses motion; and wherein said control circuit is electrically coupled to a power source; and a display panel being positioned adjacent to the ramp wherein said display panel is configured to be visible to traffic going the wrong way on the ramp, said display panel being in communication with said control unit, said display panel being turned on to display a visible alert when said control unit receives any of said inputs wherein said display panel is configured to visibly alert traffic going the wrong way on the ramp, wherein said display panel is electrically coupled to said control circuit, said display panel being turned on when said control circuit receives said third input.

12. A traffic control assembly for disabling a vehicle that is traveling the wrong way on a ramp of a highway, said assembly comprising:

a plurality of motion sensors, each of said motion sensors being positioned adjacent to a ramp of a highway wherein said plurality of motions sensors is configured to sense motion of traffic on the ramp, said motion sensors being spaced apart from each other and being distributed along a full length of the ramp wherein said plurality of motions sensors is configured to track the motion of traffic on the ramp, said plurality of motions sensors being ordered from an exit of the ramp to an entrance of the ramp with respect to the flow of traffic, said plurality of motions sensors comprising a set of first motion sensors and a set of second motion sensors, said first motion sensors being positioned on an opposite side of the ramp from said second motion sensors, each of said first motion sensors being aligned with a respective one of said second motion sensors, each of said first motion sensors including a light emitter emitting a beam of light toward said respective second motion sensor, each of said second motion sensors including a receiver for receiving the beam of light from said respective first motion sensor, each of said motion sensors being assigned a value between one and six starting from the exit of the ramp;

a control unit being in communication with each of said motion sensors, said control unit receiving a plurality of inputs having sequentially increased urgency when said motions sensors senses traffic moving the wrong way on the ramp, said control unit being in remote communication with emergency responders, said control unit contacting emergency responders when said control unit receives said input of a highest urgency, said control unit comprising:

a control circuit being electrically coupled to each of said first sensors and each of said second sensors, said control circuit receiving a first input when said motion sensors assigned the value of one senses motion, said control circuit receiving a second input when said motion sensors assigned the value of two senses motion, said control circuit receiving a third input when said motion sensors assigned the value of three senses motion, said control circuit receiving a fourth input when said motion sensors assigned the value of four senses motion, said control circuit receiving a firth input when said motion sensors assigned the value of five senses motion, said control circuit receiving a sixth input when said motion sensors assigned the value of six senses motion, said control circuit being electrically coupled to a power source; and a transceiver being electrically coupled to said control circuit, said transceiver being in communication with an extrinsic communication network thereby facilitating said transceiver to broadcast an alert to the emergency responders, said transceiver being electrically coupled to said control circuit, said transceiver broadcasting said alert when said control circuit receives said sixth input;

a disabling unit being positioned adjacent to the ramp of the highway, said disabling unit being positioned proximate the entrance of the ramp, said disabling unit being in communication with said control unit, said disabling unit broadcasting an intense burst of electromagnetic energy when said disabling unit is turned on wherein said disabling unit is configured to disable the electrical system of a vehicle traveling the wrong way on the ramp, said disabling unit being turned on when said control unit receives said input of said highest urgency, said disabling unit being electrically coupled to said control circuit, said disabling unit including a transmitter for broadcasting said intense burst of electromagnetic energy, said transmitter being actuated into a standby condition when said control circuit receives said fifth input, said transmitter being actuated to broadcast said intense burst of electromagnetic energy when said control circuit receives said sixth input;

a display panel being positioned adjacent to the ramp wherein said display panel is configured to be visible to traffic going the wrong way on the ramp, said display panel being in communication with said control unit, said display panel being turned on to display a visible alert when said control unit receives any of said inputs wherein said display panel is configured to visibly alert traffic going the wrong way on the ramp, said display panel being electrically coupled to said control circuit, said display panel being turned on when said control circuit receives said third input;

a camera being positioned adjacent to the ramp wherein said camera is configured to capture imagery of the traffic going the wrong way on the ramp, said camera being in communication with said control unit, said camera being actuated to take a photo of the traffic when said control unit receives said input of a medium urgency, said camera being electrically coupled to said control circuit, said camera being actuated to take the photo when said control circuit receives said fourth input; and a siren being positioned adjacent to the ramp wherein said siren is configured to emit an audible alarm for the traffic, said siren being in communication with said control unit, said siren being turned on when said control unit receives said input of said medium urgency wherein said siren is configured to alert the traffic going the wrong way on the ramp, said siren being electrically coupled to said control circuit, said siren being turned on when said control circuit receives said fourth input.

* * * * *